US011884990B2

(12) United States Patent
Van Krevel et al.

(10) Patent No.: US 11,884,990 B2
(45) **Date of Patent: *Jan. 30, 2024**

(54) HIGH STRENGTH HOT ROLLED OR COLD ROLLED AND ANNEALED STEEL AND METHOD OF PRODUCING IT

(71) Applicant: TATA STEEL NEDERLAND TECHNOLOGY B.V., Velsen-Noord (NL)

(72) Inventors: Joost Willem Hendrik Van Krevel, Beverwijk (NL); Nieves Cabanas Poy, Haarlem (NL)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 79 days.

This patent is subject to a terminal disclaimer.

(21) Appl. No.: 16/967,233

(22) PCT Filed: Feb. 5, 2019

(86) PCT No.: PCT/EP2019/052809

§ 371 (c)(1),
(2) Date: Aug. 4, 2020

(87) PCT Pub. No.: WO2019/154819

PCT Pub. Date: Aug. 15, 2019

(65) Prior Publication Data

US 2021/0025024 A1 Jan. 28, 2021

(30) Foreign Application Priority Data

Feb. 7, 2018 (EP) ..... 18155630

(51) Int. Cl.
*C21D 9/52* (2006.01)
*C21D 9/46* (2006.01)
(Continued)

(52) U.S. Cl.
CPC ..... *C21D 9/52* (2013.01); *C21D 6/005* (2013.01); *C21D 6/008* (2013.01); *C21D 8/0205* (2013.01);
(Continued)

(58) Field of Classification Search
None
See application file for complete search history.

(56) References Cited

U.S. PATENT DOCUMENTS

2012/0018062 A1 1/2012 Nakamura et al.
2014/0234660 A1* 8/2014 Kawata ..... B21B 1/22 148/504

(Continued)

FOREIGN PATENT DOCUMENTS

CA 3006405 A1 6/2017
EP 2327810 A1 6/2011

(Continued)

OTHER PUBLICATIONS

International Search Report and Written Opinion dated May 21, 2019 for PCT/EP2019/052809 to Tata Steel Nederland Technology B.V. filed Feb. 5, 2019.

*Primary Examiner* — Xiaowei Su
(74) *Attorney, Agent, or Firm* — Vorys, Sater, Seymour and Pease LLP

(57) ABSTRACT

A steel strip or sheet having a complex phase microstructure including one or more of ferrite, carbide free bainite, martensite and/or retained austenite in its microstructure including:

0.16-0.25 wt. % C;
2.3-4.00 wt. % Mn;
5-50 ppm B;
5-100 ppm N;
0.001-1.10 wt. % Al tot;
0.05-1.10 wt. % Si;

(Continued)

0-0.04 wt. % Ti;
0-0.10 wt. % Cu;
0-0.10 wt. % Mo;
0-0.10 wt. % Ni;
0-0.20 wt. % V;
0-0.05 wt. % P;
0-0.05 wt. % S;
0-0.10 wt. % Sn;
0-0.025 wt. % Nb
0-0.025 wt% Ca;
remainder iron and inevitable impurities.

20 Claims, 4 Drawing Sheets

(51) Int. Cl.

| | |
|---|---|
| ***C21D 8/02*** | (2006.01) |
| ***C21D 6/00*** | (2006.01) |
| ***C22C 38/14*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/12*** | (2006.01) |

(52) U.S. Cl.
CPC ..... *C21D 8/0226* (2013.01); *C21D 8/0263* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/001* (2013.01); *C21D 2211/002* (2013.01); *C21D 2211/008* (2013.01)

(56) References Cited

U.S. PATENT DOCUMENTS

| | | | | |
|---|---|---|---|---|
| 2014/0360632 | A1 | 12/2014 | Hasegawa et al. | |
| 2016/0312329 | A1 | 10/2016 | Hasegawa et al. | |
| 2017/0022582 | A1 | 1/2017 | Takashima et al. | |
| 2017/0107591 | A1 | 4/2017 | Takashima et al. | |
| 2018/0127856 | A1 | 5/2018 | Takashima et al. | |
| 2022/0074014 | A1* | 3/2022 | Seda | C22C 38/32 |

FOREIGN PATENT DOCUMENTS

| | | | |
|---|---|---|---|
| JP | 2004156095 | A | 6/2004 |
| JP | 2004225132 | A | 8/2004 |
| WO | 2015092982 | A1 | 6/2015 |
| WO | 2015151427 | A1 | 10/2015 |
| WO | 2016135794 | A1 | 9/2016 |

* cited by examiner

HIGH STRENGTH HOT ROLLED OR COLD ROLLED AND ANNEALED STEEL AND METHOD OF PRODUCING IT

CROSS-REFERENCE TO RELATED APPLICATIONS

This is a § 371 National Stage Application of International Application No. PCT/EP2019/052809 filed on Feb. 5, 2019, claiming the priority of European Patent Application No. 18155630.9 filed on February 7, 2018.

FIELD OF THE INVENTION

This invention relates to a high strength hot rolled or cold rolled and annealed steel and method for producing it.

BACKGROUND OF THE INVENTION

In recent years, (advanced) high strength steel sheets, AHSS, are increasingly used in car components to reduce weight and fuel consumption. Series of (advanced) high strength steels, such as HSLA, Dual phase (DP), Ferritic-bainitic (FB) including stretch-flangeable (SF), Complex phase (CP), Transformation-induced plasticity (TRIP), Hot-formed, Twinning-induced plasticity (TWIP) have been developed to meet the growing requirements.

However, AHSS sheet steels cannot be applied easily to a wide variety of car components because their formability is relatively poor. As steels became increasingly stronger, they simultaneously became increasingly difficult to form into more complex automotive parts. Actually, the real application of AHSS steels (DP, CP and TRIP) to car components is still limited by their formability. Therefore, improving formability and manufacturability become an important issue for AHSS application.

The relationship between elongation and strength of AHSS has been well established from the standard tensile tests and leads to the well-known strength-elongation banana curve. The microstructural parameters that govern the strength and the ductility of AHSS are understood qualitatively and to a lesser degree quantitatively. However, elongation is not the only parameter governing formability in AHSS. AHSS grades have additional relevant failure mechanisms compared to mild steels. This is mainly caused by local failure which is observed more commonly in AHSS due to multi-phase structure and phase transformations during deformation. These local failures do not necessarily correlate with elongation and/or n-value. Therefore, steels having higher (uniform and total) elongations do not always have a good formability. The microstructures improving ductility are different from those improving formability. The position in the diagram of the elongation-strength is not sufficient to select the proper materials for all parts. In most cases, another relationship between formability and strength is needed for steel grade selection. It is essential to study the behaviour of AHSS under all relevant forming conditions. There are four basic operations in automotive press forming with various stress and strain states: deep drawing, stretching, stretch-flanging and bending. Each forming mode has a specific governing mechanical parameter such as r-value (the ratio between plastic strain in-plane and the plastic strain through-the-thickness of a tensile test sample), λ (hole expansion ratio) value, and bending angle. For some difficult-to-form parts, high punchability, stretch-flangeability and fatigue properties are demanded in the application.

The strength-elongation banana curve illustrates that high strength comes at the expense of good elongation, and continued efforts are being made to escape the straightjacket of the curve.

However, mechanical properties (strength, elongation, λ, . . . ) are not the only properties that are important for these types of steels. Weldability is also a key parameter as well as galvanisability. If a high strength steel cannot be welded, it is relatively useless in constructing a vehicle, and galvanisability is crucial in guaranteeing long term protection against corrosion.

To achieve a tensile strength of over 1200 MPa the state-of-the-art proposes various solutions, each with their drawbacks:

EP2327810-A1 discloses a carbon content of over 0.2 wt. %. This causes weldability issues. WO2016135794-A1 discloses a silicon content of over 1.2 wt. % which causes complications during galvanising. Also in WO2016135794-A1 the use of Nb causes excessive rolling forces. The use of titanium as proposed in WO2015151427-A1 complicates pickling and thus galvanising. The combination of high silicon and boron contents in US20170022582-A1 results in excessive formation of Si—B—O(—Mn) compounds during continuous annealing. These liquid compounds also complicate galvanising. If the silicon is too low and the aluminium is too low, as proposed in WO2015092982-A1 the tensile elongation is too low, and too high manganese as proposed by US20140360632-A1 results in excessive cold rolling forces and causes brittleness during cold rolling causing e.g. excessive edge cracking. In addition, too high a Mn level makes galvanising more challenging and gives rise to excessive Mn segregation.

SUMMARY OF THE INVENTION

It is an object of the present invention to provide a hot-rolled steel grade which combines very high yield and tensile strength with a good elongation and excellent hole expansion ratio values.

It is also an object of the present invention to provide a cold-rolled steel grade which combines very high yield and tensile strength with a good elongation and excellent hole expansion ratio values.

It is also an object of the present invention to provide a steel grade with a yield strength of at least 600 MPa after temper rolling and a tensile strength of at least 1200 MPa.

It is also an object of the present invention to provide a steel grade with a good weldability and galvanisability.

One or more of the objects is reached with a steel strip or sheet having a complex phase structure comprising one or more of ferrite, carbide free bainite, martensite and/or retained austenite in its microstructure comprising (all compositional percentages are in wt. %, unless otherwise indicated):

0.16-0.25 wt. % C;
1.50-4.00 wt. % Mn;
5-50 ppm B;
5-100 ppm N;
0.001-1.10 wt. % Al tot;
0.05-1.10 wt. % Si;
0-0.04 wt. % Ti;
0-0.10 wt. % Cu;
0-0.10 wt. % Mo;
0-0.10 wt. % Ni;
0-0.20 wt. % V;
0-0.05 wt. % P;
0-0.05 wt. % S;

0-0.10 wt. % Sn;

0-0.025 wt. % Nb 0-0.025 wt. % Ca;

remainder iron and inevitable impurities, wherein the steel strip or sheet after hot-rolling has a yield strength of at least 500 MPa and a tensile strength of at least 850 MPa, or wherein the steel strip or sheet has a yield strength of at least 550 MPa and a tensile strength of at least 1000 MPa after cold-rolling and annealing.

Preferable embodiments are also provided.

The steel strip or sheet according to the invention can be provided as a hot-rolled steel strip or sheet or, with the same chemistry, as a cold-rolled and annealed steel strip or sheet. Both hot-rolled and cold-rolled strip or sheet benefit from the balanced chemistry and microstructure, albeit that the levels of yield and tensile strength of the hot-rolled steel strip are lower than those achievable with the cold-rolled and annealed variant. If the steel is provided as a cold-rolled and annealed steel sheet or strip, then the mechanical properties of the intermediately produced hot-rolled strip that is subsequently cold-rolled and annealed may have the properties as claimed, but this is not necessarily required to achieve the properties after cold-rolled and annealing. The cold-rolled and annealing and the tailored chemistry will provide the claimed properties and microstructure as claimed even if the intermediate hot-rolled steel strip does not. If the steel is provided as a finished hot-rolled steel sheet or strip, then the mechanical properties of the finished hot-rolled steel are as claimed.

DETAILED DESCRIPTION

Figure 1:
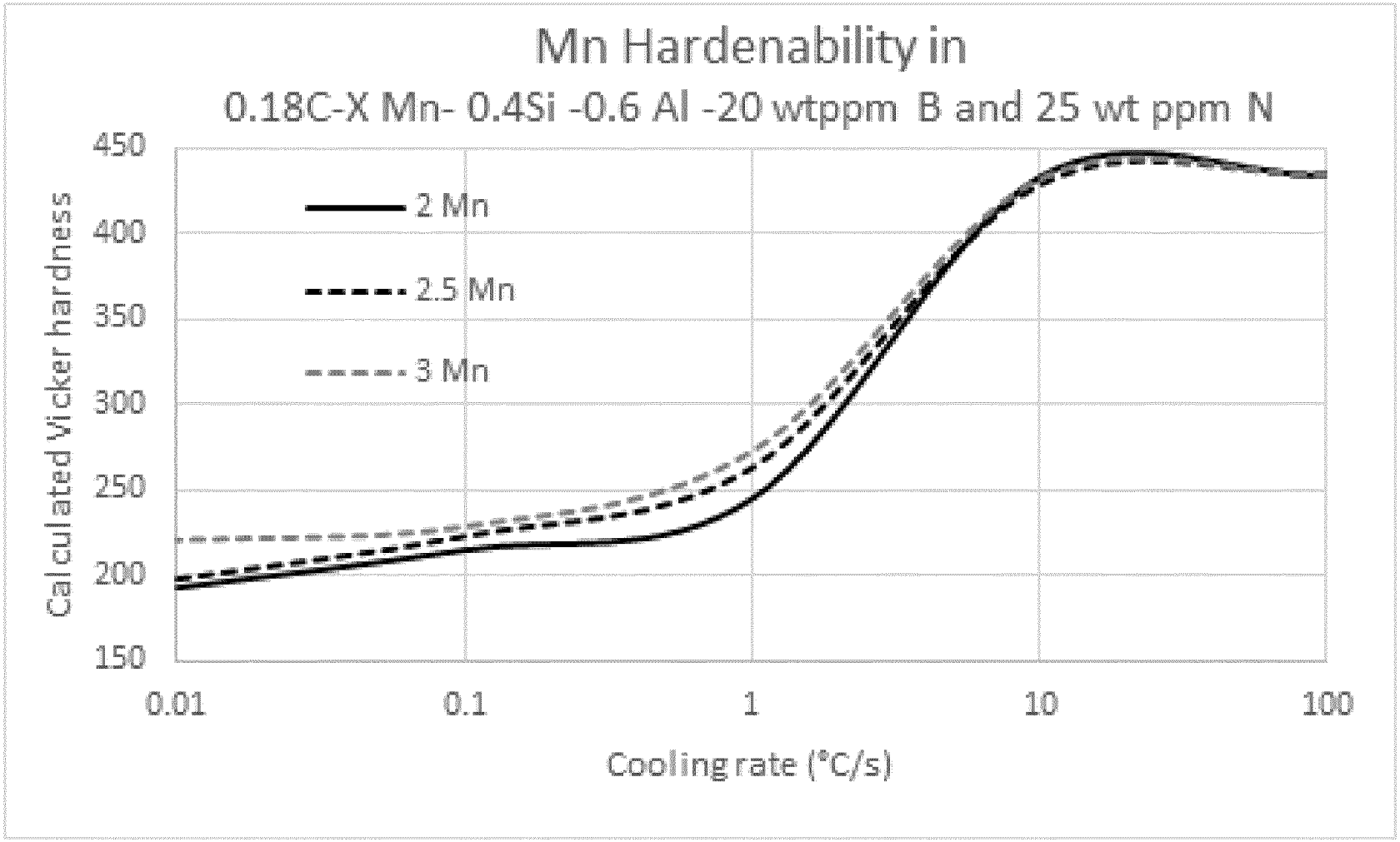
FIG. 1 shows the result of the calculation of hardenability with increasing manganese content as a function of cooling rate after austenisation.

The invention is a steel strip with a gauge preferably between 0.5 and 3.5 mm, preferably between 0.6-2.5 mm, which when continuously manufactured as strip is often provided as a coiled strip. From this strip sheets can be cut. The sheets may be in the form of rectangular pieces, or in the form of blanks that may be used to produce parts by deep drawing, stretching, stretch-flanging, roll-forming or bending.

The microstructure may contain between 0 to 25 vol. % of ferrite. The amount of (tempered) martensite is between 0 and 50 vol. %, the remainder being carbide free bainite. The carbide free bainite is considered to consist of bainite with retained austenite without the presence of cementite. The overall microstructure is therefore free from other microstructural components, and in particular free from carbon-rich microstructural components such as coarse cementite or pearlite. However, insignificant and/or unavoidable amounts of these other microstructural components which do not materially affect the properties or performance of the steel according to the invention may be allowable.

Preferably the yield strength of the hot-rolled steel strip or sheet is at least 600 MPa.

Preferably the yield strength of the cold-rolled and annealed steel strip or sheet is at least 600 MPa.

More preferably the yield strength of the cold-rolled and annealed steel strip or sheet is at least 650 MPa.

The chemical composition is as described below. All elements are given in wt. % unless indicated otherwise. The microstructure of the steel phases consists of a mixture of (carbide free) bainite, martensite and/or retained austenite. No ferrite or pearlite is ideally present in the microstructure. Insignificant residual amounts of ferrite that do not significantly affect the microstructure may be allowable, but are not desirable. No pearlite should be present in the microstructure.

Manganese (Mn) is present between 2.3 and 4 wt. % Mn. Full austenitisation during the last continuous annealing step is important, and the manganese is instrumental in achieving this full austenitisation. Preferably the manganese content is between 2.3 and 3.8 wt. %, more preferably between 2.3 and 3.7 wt. % and even more preferably it is between 2.3 and 3.6 wt. %. A suitable maximum value for manganese is 3.0 wt. %, or even 2.8 wt. %. By means of illustration JMatPro calculations with 2.0, 2.5 and 3.0 wt. % Mn in steel 5 show the influence of manganese hardenability. This effect is generally applicable to the steels according to the invention. The effect of manganese is visible over the wide ranges as disclosed herein above, but the control of the hardenability improves with narrower ranges of manganese. With higher amounts of manganese the hardenability at lower cooling rates increases with. Optionally, the lower limit increases to 1.6 wt. %.

Carbon (C): A minimum carbon concentration is required for hardenability and sufficient austenite formation during continuous annealing. Too low a carbon concentration does not allow full austenitisation during continuous annealing. Hence a lower boundary range of 0.16 wt. %, preferably 0.165 wt. %, more preferably 0.17 wt. % is used and most preferably 0.175 wt. % is used. A high carbon concentration results in improper welding performance. A value exceeding 0.24 wt. % would strongly reduce weldability, so 0.24 is chosen as a preferable upper boundary. Preferably the carbon content is at most 0.21 wt. %, more preferably at most 0.205 wt. % is used.

Boron (B) is added to improve hardenability where the bainite start temperature (Bs) and martensite start temperature (Ms) are not or minimally influenced. Boron is hardly soluble in the bulk matrix and hence segregates to the grain boundaries where it partially forms iron-boride or iron-boride-carbide compounds. By segregation to grain boundaries the boron suppresses austenite to ferrite transformation. As it segregates, boron both delays transformation from austenite to ferrite, bainite and pearlite and hence excessive immediate phase transformation is prevented. This helps in controlling the cooling path in a continuous annealing plant. Another advantage of boron segregation to the grain boundaries is that it partially replaces phosphorus (P). Phosphorus on grain boundaries can cause brittleness after welding, and therefore replacement of phosphorus with boron improves weldability. It is inevitable that part of the boron reacts with nitrogen to form boron nitrides. This reaction can partially or almost completely be suppressed by adding elements in sufficiently high concentrations that have a stronger affinity to nitrogen than boron. Hence, the composition in the invention should either contain titanium and/or aluminium, which bind to nitrogen and thereby prevent BN formation.

Due to its hardenability the strength of the steel according to the invention can be as high as 1300-1550 MPa. Too high a boron content (above 0.005 wt. % (=50 ppm)) is to be avoided as its hardenability effect saturates above 50 ppm and adverse effects of the boron presence may develop. A high boron contents can lead to brittleness through build-up of excessive iron-boride or iron-boride-carbide compounds. Preferably, the boron content is lower than 0.004 wt. % (40 ppm) and more preferably lower than 0.003 wt. % (30 ppm), as boron also has the tendency to accumulate at the surface in the form of low melting mixed oxides. This negatively affects the zinc coatability. On the other hand, for good hardenability it is important that all grains contain a sufficient amount of boron. For this a minimum amount of 0.0005 wt. % (5 ppm) is required. Values lower than 0.0005 wt. % may lead to inhomogeneous hardenability and may lead to strength variation. Hence, from a practical plant control perspective and to achieve a consistent quality the boron content is preferably at least 0.001 wt. % (10 ppm), more preferably at least 0.0012 wt. % and even more preferably more than 0.0015 wt. % (15 ppm).

Nitrogen (N) is preferably below 0.01 wt. % (100 ppm). It is preferably bound to aluminium or titanium so that the boron nitride formation is prevented. A suitable maximum value is 0.006 wt. % (60 ppm). More preferably, nitrogen is below 0.005 wt. % (50 ppm). At least 0.0005 wt. % (5 ppm) nitrogen is present in the steel.

Titanium (Ti) is optionally used to bind nitrogen. It could be present as a residual element only, i.e. not added as an alloying element but an inevitable result of the steelmaking process, and if added as an alloying element, the amount is preferably at least 0.010 wt. % to bind nitrogen and thereby protect the boron from forming BN. More preferably the amount of titanium is at least 0.015 wt. %. In this respect the titanium content is preferably at least stoichiometric or slightly overstoichiometric with regard to nitrogen (Ti/N>3.42). If the titanium is not at least stoichiometric or slightly overstoichiometric with regard to nitrogen, then the aluminium content must be such that the compound effect of Ti and Al is at least stoichiometric or slightly overstoichiometric with regard to nitrogen. In other words: Ti (wt. %) −3.42.N (wt. %) ≥0. If not all nitrogen is bound to titanium (which is the stronger nitride former), then the remainder of nitrogen, N*, must be bound to aluminium Al (wt. %) −1.92.N* (wt. %) ≥0. If no titanium is present in the steel, then N=N*. All inventive steels have Ti and Al contents to ensure that all nitrogen is bound to either Ti or Al.

A suitable maximum amount is 0.040 wt. % as it can negatively affect the quality of a zinc coating because during hot rolling FeTiOx could be formed which are difficult to remove from the surface by pickling. Preferably, the titanium content is at most 0.030 wt. %, and more preferably it is at most 0.025 wt. % and most preferably at most 0.021 wt%.

Aluminium is used to bind oxygen and nitrogen as oxides, nitrides or mixed oxynitrides in the form of inclusions or precipitates. A higher concentration of Al is used to suppress cementite formation. Aluminium is what is called a killing agent. It ensures that the oxygen content in the liquid steel is reduced so that no oxygen bubbles form during casting, thereby preventing porosity. Porosity is detrimental for most important properties. Any excess aluminium can bind nitrogen to protect the boron, particularly in the absence of titanium. The aluminium concentration is preferably at least 0.030 wt. % as below that concentration titanium needs to be added to suppress free nitrogen. A suitable maximum amount is 1.10 wt. %, preferably at most 0.75 wt. %, more preferably at most 0.67 wt. %. The value of aluminium in the context of this invention is given as the total amount in the steel, Al_tot, which is the sum of aluminium present as alumina and any other aluminium, e.g. bound to nitrogen or unbound in solid solution, usually referred to as Al_sol. So Al_tot=Al_sol+Al in $Al_2O_3$.

Silicon is also a killing agent and can bind oxygen in the liquid steel. It is also used to strengthen the steel, mainly by solid solution hardening, and to suppress cementite formation. In the presence of silicon the formation of retained austenite after continuous annealing is enhanced. Silicon may however deteriorate the quality of the zinc coating and may give rise to tiger stripes on the zinc coating, which are difficult or sometimes impossible to remove from the hot-rolled steel by pickling, and may remain visible after cold rolling and galvanising. In addition, high amounts of silicon can result in excessive (sub)surface oxide formation which deteriorates zinc adhesion to the steel substrate. Further, high silicon contents may lead to welding issues due to influx of liquid zinc from the galvanised surface, also known as liquid metal embrittlement.

Therefore there is a lower and an upper silicon limit. Preferably, at least 0.050 wt. % silicon is present. However, more preferably it is present in more significant concentrations as 0.25 wt. % and even more preferably at least 0.30 wt. % is present in the steel. A suitable maximum amount is 1.10 wt. %. It is preferable that Σ(Al+Si) ≤1.2 wt. %. It is also preferable that Σ(Al+Si) ≥0.60 wt. %. Preferably Σ(Al+Si) is between 0.9 and 1.15 wt. %.

Calcium (Ca) can be present in the steel and its content will be higher in case a calcium treatment is used for inclusion control and/or anti-clogging practice to improve casting performance. The small amount of calcium is added to desulphurise and/or deoxidise the liquid steel and/or to modify any harmful inclusions. The use of a calcium treatment is optional in the present invention. If no calcium treatment is used, Ca will be present as an inevitable impurity from the steel making and casting process and its content will be at most 0.025%, preferably at most 0.015% and typically from 0.002 wt. % to at most 0.010 wt. %. If a calcium treatment is used, the calcium content of the steel strip or sheet generally does not exceed 100 ppm, and is then usually between 5 and 70 ppm. In some cases, for instance to suppress the amount of composite $Al_xO_y$ inclusions in the final steel, it is preferred not to use a calcium treatment. In that case any calcium is then considered a residual element, and the values of residual calcium are preferably below 100 ppm, more preferably below 70 ppm.

Sulphur as well as phosphorus is preferably kept to a minimum, and is at most 0.05 wt. %, preferably at most 0.02 and more preferably at most 0.01 wt. %. For low sulphur grades the sulphur content is at most 50 ppm (0.005 wt. %), preferably at most 0.002 wt. % and more preferably at most 0.0015 wt. %.

Additions of molybdenum, nickel, copper, niobium, chromium can strongly affect the properties of the alloy. These are however not essential for the invention and will therefore be limited to maximum allowable amounts, and preferably these are limited to the level of residual elements aka inevitable impurities which are the inevitable and unavoidable impurities present in the steel as a result of the production process.

Chromium is to be avoided because it is a ferrite former. A maximum allowable amount is 0.05 wt. %. Niobium is to be avoided because of the increase in rolling force it causes in the hot-strip mill. A maximum allowable amount is 0.025 wt. %. Preferably, there is no niobium in the steel except as an inevitable impurity, i.e. a residual element. Molybdenum, nickel and copper are individually preferably limited to 0.10 wt. %. More preferably the sum on Mo, Ni and Cu does not exceed 0.10 wt. %. However, preferably no additions of molybdenum, nickel, copper, niobium, chromium are made, and the amounts present in the steel are residual levels only Optionally, tin is used to improve the quality of the zinc coating. With the presence of silicon it helps to increase the zinc coating quality and to reduce tiger stripes. Its limits are between impurity levels and 0.1 wt. %. Sn is difficult to remove from the steel scrap, hence preferably it is limited to 0.08 wt. %.

Vanadium can be added to the alloy and increases hardenability while it can also form precipitates with nitrogen but more preferably with carbon. At low contents it can improve the strength without jeopardising elongation. Excessive vanadium has however the tendency to form large content of martensite without martensite tempering. The vanadium level is limited to 0.20%, preferably to at most 0.15, more preferably at most 0.135 wt. % and most preferably at most 0.13 wt. %.

In an embodiment the steel strip or sheet according to the invention is provided with a metallic coating on the upper and/or lower surface, preferably a zinc based coating. The coating of the hot-rolled strip with a metallic coating can e.g. be done in an electrolytic deposition process, or by hot dipping in a heat-to-coat (HTC) cycle. The heat in the HTC-cycle can have a beneficial effect because of some tempering of the martensite, which may benefit elongation values. On the other hand, too high a temperature may adversely affect the microstructure. The term upper and/or lower surface refer to the major surfaces of the strip. The coating of the cold-rolled strip can be done immediately after the annealing process, or as a HTC-cycle. Alternative coating processes like zinc jet spraying may also be used. Known zinc-based coatings may be used.

The inventors found that for steels according to the invention the modified equation proposed by Ito and Bessyo for the cracking parameter $P_c$ was a good predictor for weldability:

$$P_c = C + \frac{Si}{30} + \frac{Mn + Cu + Cr}{20} + \frac{Mo}{15} + \frac{V}{10} + \frac{d}{600}$$

wherein the alloying contents are given in wt. %. The plate thickness, d, is given in mm (Ito & Bessyo, Weldability formula for high strength steels, I.I.W. Document IX-576-68). Steels with $P_c$ values equal to or below 0.365 were found to perform better in terms of weldability than those with a value above 0.365.

The largest advantage is however not only the lower HAZ values, but a lower C content drastically improves the welding quality with respect to the critical sulphur and phosphorus contents where especially the latter accumulates on grain boundaries and causes embrittlement. In addition, excessive silicon is avoided and it may lead to embrittlement after welding due to excessive internal oxidation and/or liquid metal embrittlement.

Here, the addition of boron strongly improves the welding performance as boron preferably segregates at grain boundaries, hence reducing phosphorus segregation (see "Phosphorous and boron segregation during resistance spot welding of advanced high strength steels", Amirthalingam, M., den Uijl, N. J., van der Aa, E. M., Hermans, M. J. M. & Richardson, I. M. 2013 Trends in Welding Research, Proceedings of the 9th International Conference. Chicago, Illinois: ASM International, p. 217-226).

The invention is also embodied in the method of manufacturing a hot-rolled or cold-rolled and annealed steel strip or sheet having a complex phase microstructure comprising one or more of carbide free bainite, martensite and/or retained austenite in its microstructure, the method comprising the step of casting a thick or thin slab, comprising:

0.16-0.25 wt. % C;
1.50-4.00 wt. % Mn;
5-50 ppm B;
5-100 ppm N;
0.001-1.10 wt. % Al_tot;
0.05-1.10 wt. % Si;
0-0.04 wt. % Ti;
0-0.10 wt. % Cu;
0-0.10 wt. % Mo;
0-0.10 wt. % Ni;
0-0.20 wt. % V;
0-0.05 wt. % P;
0-0.05 wt. % S;
0-0.10 wt. % Sn;
0-0.025 wt. % Nb;
0-0.025 wt. % Ca;

remainder iron and inevitable impurities; followed by the step of reheating the solidified slab to a temperature of between 1050 and 1250° C., hot rolling the steel slab and finishing said hot rolling at a finish hot rolling temperature at the $Ar_a$-temperature or higher, cooling the hot-rolled strip at a cooling rate of between 5 and 220° C./s and coiling the hot rolled steel strip or sheet in the temperature range between 200 and 625° C., optionally followed by cold-rolling and annealing, wherein the finished steel strip or sheet after hot-rolling has a yield strength of at least 500 MPa and a tensile strength of at least 850 MPa, or wherein the finished steel strip or sheet after the optional cold-rolling and annealing has a yield strength of at least 550 MPa and a tensile strength of at least 1000 MPa.

Again, if the steel is provided as a finished cold-rolled and annealed steel sheet or strip, then the mechanical properties of the intermediately produced hot-rolled strip that is subsequently cold-rolled and annealed may have the properties as claimed, but this is not necessarily required to achieve the properties after cold-rolled and annealing. The cold-rolled and annealing and the tailored chemistry will provide the claimed properties and microstructure as claimed even if the intermediate hot-rolled steel strip does not.

If the steel is provided as a finished hot-rolled steel sheet or strip, then the mechanical properties of the finished hot-rolled steel are as claimed.

Preferable embodiments are also provided. Preferably the yield strength of the hot-rolled steel strip or sheet is at least 600 MPa. Preferably the yield strength of the cold-rolled and annealed steel strip or sheet is at least 550 MPa, or 600 MPa after temper rolling. More preferably the yield strength of the cold-rolled and annealed steel strip or sheet is at least 650 MPa. Typical temper rolling reductions are between 0.1 en 1% reduction. Preferably the reduction is at most 0.5%.

The choice of the coiling temperature is such that precipitation of vanadium carbides and titanium carbides is largely suppressed in the hot-rolled and cooled coil. This is important to keep the cold-rolling forces down of the subsequent cold-rolling process, if applicable. Preferably coiling is done below 605° C., more preferably below 595° C. The advantage is that internal oxidation of the coil is suppressed in addition to the suppression of the precipitate formation in the form of carbides in the intermediate hot rolled product. The thickness range of the hot-rolled steel is preferably between 2 and 7 mm, more preferably at least 2.5 and/or at most 5 mm. The strength level of the hot-rolled steel and the tensile strength level varies between 800 and 1200 MPa when coiled between 550 and 350° C. Higher strength can be obtained by coiling at lower temperature. The material is pickled after hot rolling, optionally with addition of a pickling inhibitor. Pickling typically proceeds at a temperature of 60-90° C. using acid HCl solution, optionally with additional brushing or with stirring. Pickling is important because of the tendency of boron to accumulate at the surface in the form of low melting mixed oxides. This negatively affects the zinc coatability and these have to be removed by pickling. A bonus effect of the tendency of boron to accumulate at the surface and its subsequent removal is that the surface layer of the steel strip is depleted of boron in comparison to the bulk of the strip, which is deemed to be beneficial for the bendability of the strip.

The cold-rolled and annealed steel sheet of the invention is produced by pickling a hot-rolled steel sheet, cold rolling the pickled sheet to form a cold-rolled steel sheet, and then performing hot-dip galvanizing of the cold-rolled steel sheet in a continuous hot-dip galvanizing line, as is the case with the normal hot-dip galvanized steel sheet. The process conditions for the hot rolling to produce the hot-rolled steel sheet, the conditions for the pickling, the conditions for the cold rolling to produce the cold-rolled steel sheet, and the conditions for galvanizing in the hot-dip galvanizing process are not particularly limited, and hence the conditions which are normally employed in manufacturing the hot-dip galvanized steel sheet can be employed in the invention. More specifically, in the hot rolling, a heating temperature is set to a range from 1100 to 1300° C., a finishing temperature in the austenitic range but not less than 840° C., and a coiling temperature to not less than 200° C. The cold rolling reduction in cold rolling is not particularly limited.

The invention will be further explained by the non-limiting FIGS. 1 to 4.

FIG. 1 shows the result of the calculation of hardenability with increasing manganese content as a function of cooling rate after austenitisation.

Figure 2:
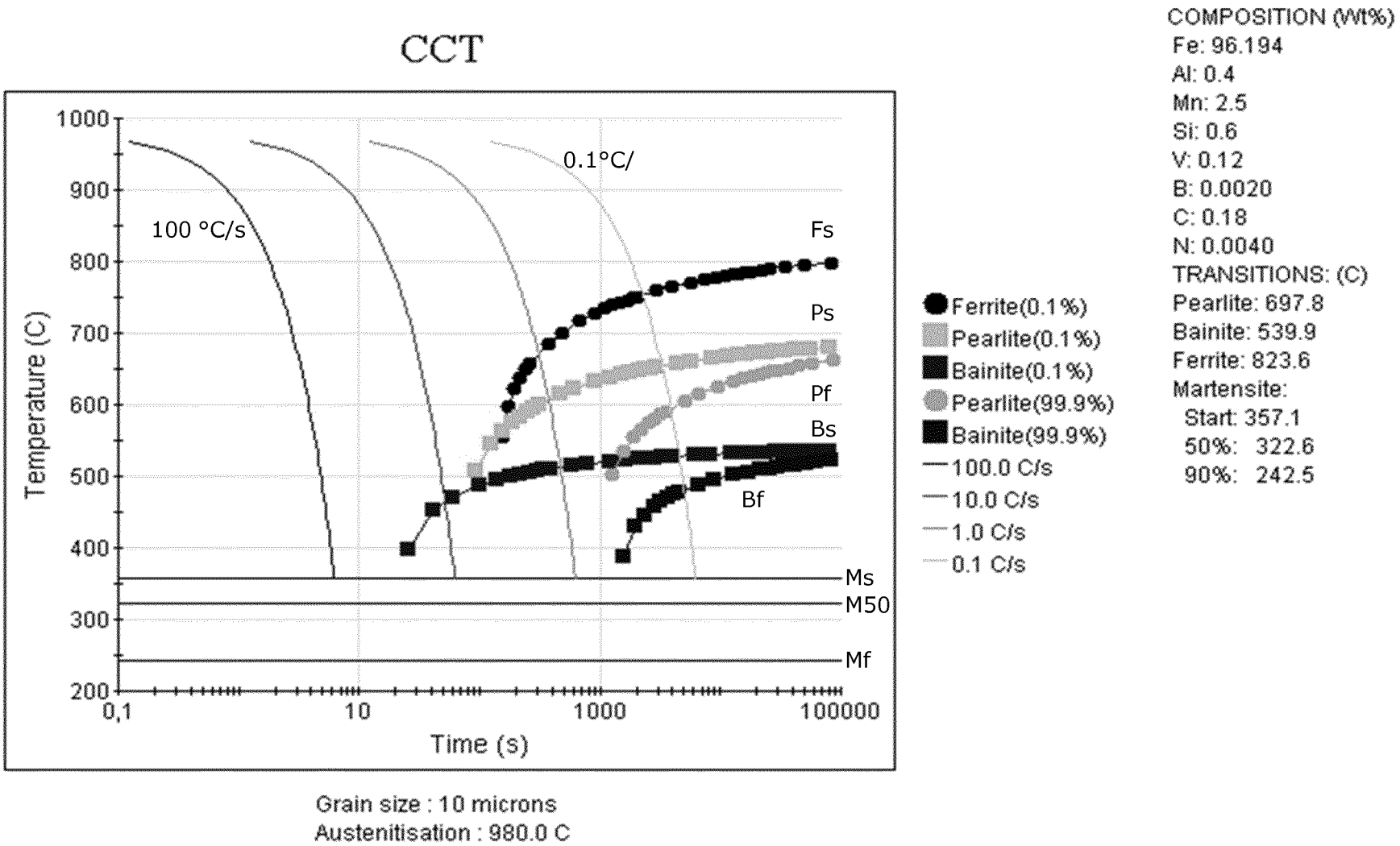
FIG. 2 shows the calculated CCT-diagram of a steel according to the invention.

FIG. 2 shows the calculated CCT-diagram of a steel according to the invention. Four cooling curves are indicates wherein the first (fastest cooling rate) results in a fully martensitic steel, the second in a bainitic-martensitic steel and the two slowest cross the ferrite start, pearlite start, bainite start and martensite start lines. By using these CCT-diagrams the optimal cooling rate after hot-rolling or annealing can be determined.

Figure 3:
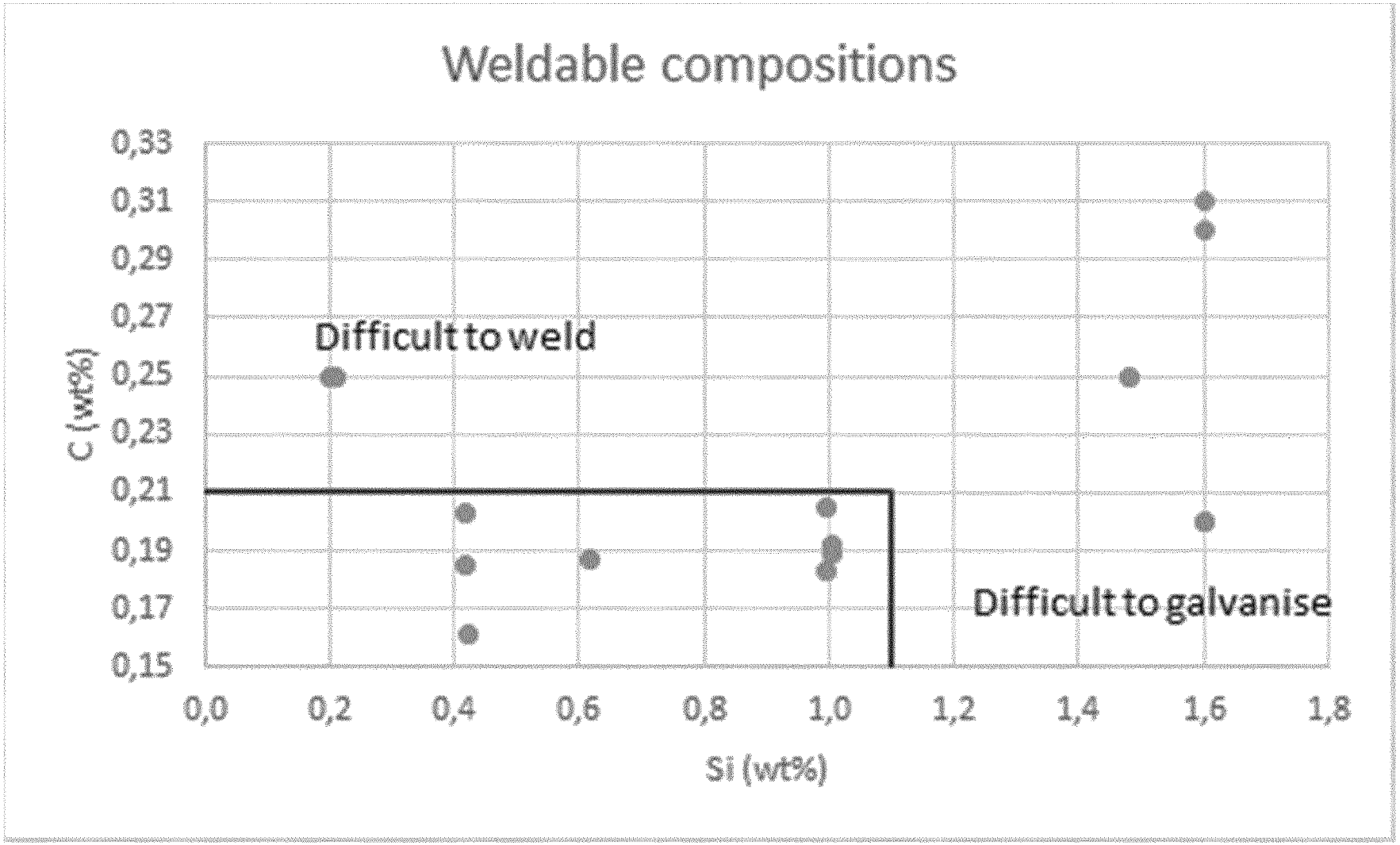
FIG. 3 shows the balance that has to be struck between weldability and galvanisability.

FIG. 3 shows the balance that has to be struck between weldability and galvanisability. The square in the lower left corner of the graph shows combinations of carbon and silicon that result in good weldability and in good galvanisability.

Figure 4:
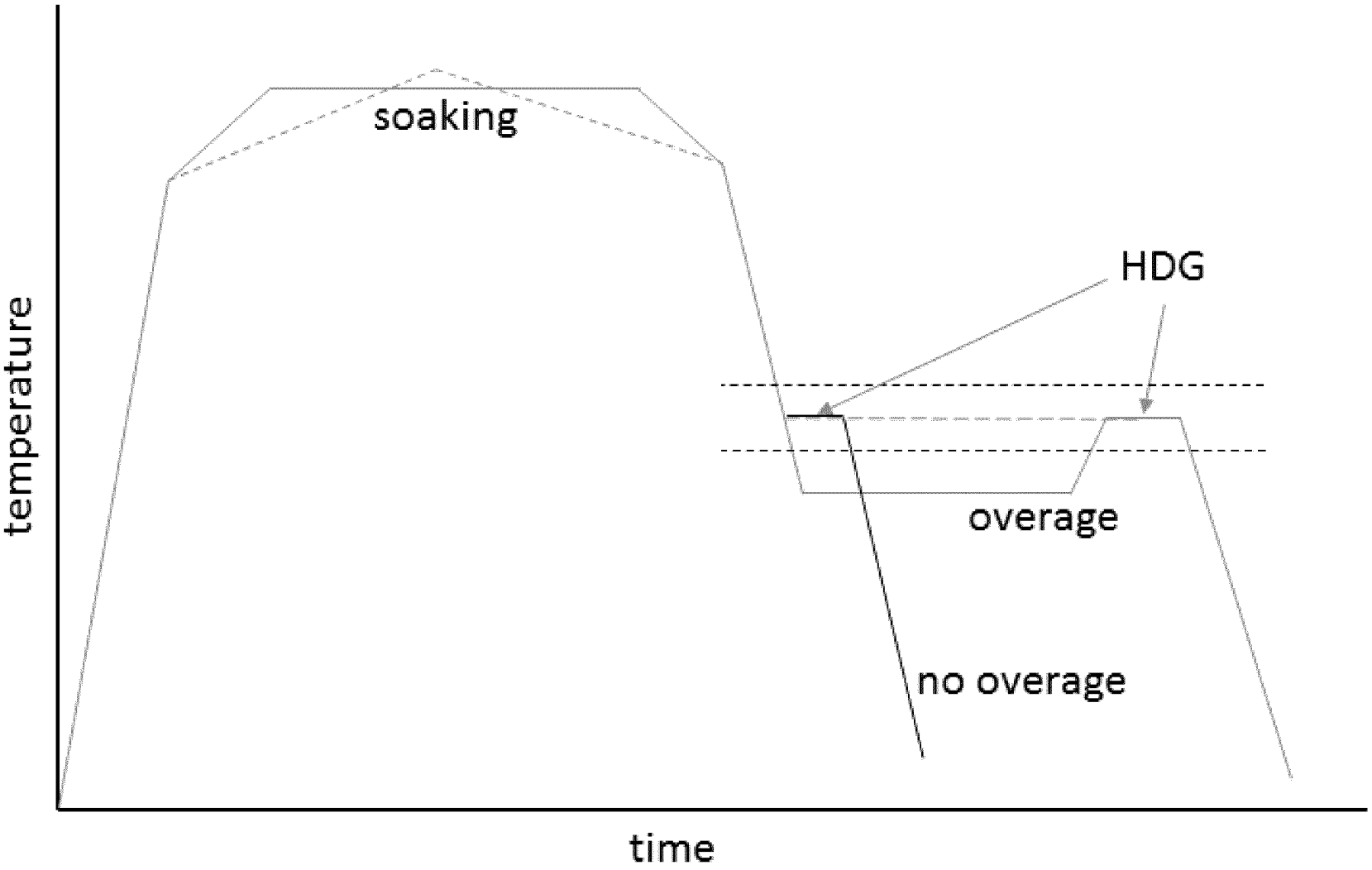
FIG. 4 shows annealing steps.

The annealing steps will be hereinafter described with reference to schematic FIG. 4. The heating can be performed by any known means and the average heating rate is between 10 to 100° C./s. First, in the soaking process, the temperature is set to a range from 760 to 900° C., and the time at this temperature is in a range of 15 to 250 seconds. This soaking process is very critical to form the required microstructure. Depending on the desired microstructure and mechanical properties the soaking in the continuous annealing takes place at an annealing temperature of between $A_{c1}$ and $A_{c3}$ (intercritical) or above $A_{c3}$ (austenitic). At austenitic annealing primarily bainite/martensite/retained austenite are formed in the final microstructure and at intercritical annealing ferrite is formed as well in the microstructure. The soaking does not have to be performed isothermally. The soaking may be performed isothermally, as depicted in FIG. 4, or non-isothermally as depicted in FIG. 4 with the dashed line. Then, the sheet is cooled until it reaches the overageing temperature and the time at this overageing temperature is in a range of 15 to 500 seconds. If the overageing temperature is below the temperature of the molten zinc or zinc alloy (temperature ranges of the melt is indicated with the two dashed horizontal lines, then the strip is reheated, e.g. by induction, and hot-dip galvanised. In FIG. 4 cooling from the soaking temperature to the overageing temperature comprises cooling the steel at an average cooling rate of between 1 and 20° C./s, preferably between 1 and 10° C./s to a temperature of close to (above or under) the Ac1 temperature (primary cooling) and then cooling the steel at an average cooling rate of between 10 and 100° C./s to a temperature of 350 to 500° C. (secondary cooling) to prevent cementite formation, followed by galvanising (HDG). After galvanizing the strip is cooled to ambient temperatures. In case no overageing takes place, the galvanizing takes place during the cooling from the soaking temperature. This is depicted in schematic FIG. 4 ("no-overage"). After cooling the hot dip galvanised material it is temper rolled to obtain the correct shape, zinc (alloy) coating roughness and mechanical properties.

After the continuous annealing, optionally followed by hot-dip galvanising, but prior to temper rolling, the coiled steel may be batch annealed at a low temperature between 170 to 350° C., preferably between 170 and 250° C. during 12 to 250 hours, preferably during 12 to 30 hours, after which it is allowed to cool to ambient temperature. This low temperature anneal is beneficial for elongation values because it serves as a tempering of the hard phases in the microstructure. The strip thus obtained can be coated using PVD, jet spray or any other zinc deposition technique. Optionally the strip is continuous annealed as described above but without hot-dip galvanising. After the subsequent batch annealing or during heating in a zinc deposition installation between 170 and 350° C., the strip is zinc coated using PVD, jet spray or any other of zinc deposition technique (but not HDG).

The applied zinc coating (HDG, PVD, jet spray or otherwise applied) consists of a zinc coating or a zinc alloy coating. The zinc alloy coating may comprise 0.3-4.0 wt. % Mg and 0.05-6.0 wt. % Al, optionally at most 0.2% of one or more additional elements, unavoidable impurities and the remainder being zinc. The minimum level of aluminium of 0.05 wt. % can be used, as it is not important to prevent all reactions between Fe and Zn. Without any aluminium, thick solid Fe—Zn alloys grow on the steel surface and the coating thickness cannot be regulated smoothly by wiping with a gas. An aluminium content of 0.05 wt. % is enough to prevent problematic Fe—Zn alloy formation. Preferably, the minimum aluminium content in the zinc alloy coating layer is at least 0.3 wt. %. Optionally the zinc coated strip is galvannealed. Instead of a zinc alloy coating an aluminium-silicon based coating may be used, for instance for hot-forming applications.

In an embodiment the cold-rolled and annealed steel strip has an Rp (yield stress) of at least 600 MPa and an Rm (tensile strength) of at least 1200 MPa. Preferably the Rp is at least 650 MPa. Preferably the Rm (tensile strength) is at least 1300 MPa.

The reported tensile properties are based on 3155 tensile geometry for the cold-rolled material and A50 for the hot rolled material (gauge length 50 mm) with tensile testing parallel to rolling direction according to EN 10002-1/ISO 6892-1 (2009).

To determine the hole-expanding ratio λ, which is a criterion for stretch-flangeability, three square samples (90×90 $mm^2$) were cut out from each sheet, followed by punching a hole of 10 mm in diameter in the sample. Hole-expansion testing of the samples was done with upper burring. A conical punch of 60° was pushed up from below and the hole diameter $d_f$ was measured when a through-thickness crack formed. The hole-expansion ratio 2 was calculated using the formula below with $d_0$=10 mm:

$$\lambda = \frac{d_f - d_0}{d_0} \times 100\%$$

TABLE 4

Microstructure estimation from dilatometry/microstructure analysis after austenitic (840° C.) or intercritical continuous annealing (800° C.)

| CR material | Annealing (° C.) | Overageing temperature (° C.) (duration 40-60 s) | Microstructure B/A | F | M/A |
|---|---|---|---|---|---|
| 1 | 800 | 440 | 40 | 20 | 40 |
| | 840 | 400 | 40 | 0 | 60 |

TABLE 4-continued

Microstructure estimation from dilatometry/microstructure analysis after austenitic (840° C.) or intercritical continuous annealing (800° C.)

| CR material | Annealing (° C.) | Overageing temperature (° C.) (duration 40-60 s) | Microstructure B/A | F | M/A |
|---|---|---|---|---|---|
| 2 | 800 | 400 | 60 | <10 | 30 |
| 3 | 840 | 400 | 67 | 5 | 28 |
| | | 440 | 57 | 5 | 38 |
| 4 | 840 | 400 | 47 | 10 | 43 |
| | | 440 | 42 | 9 | 49 |
| 5 | 840 | 400 | 68 | 20 | 12 |
| | | 440 | 70 | 18 | 12 |
| 6 | 840 | 400 | 77 | 15 | 8 |
| | | 440 | 72 | 20 | 8 |
| 7 | 840 | 400 | 57 | 0 | 43 |
| | | 440 | 52 | 0 | 48 |
| 8 | 840 | 400 | 5 | 5 | 90 |
| | | 440 | 25 | 0 | 75 |

(B/A = carbide free bainite (bainite (B) with retained austenite (A)), F = Ferrite and M/A = Martensite (with retained austenite (A)).

TABLE 1

Chemical composition of cold rolled and annealed strip and transformation temperatures (* = ppm, Tnr, Ac1, Ac3, Bs, Ms are calculated values, see below table 2), (1-8, 11-12 inventive examples, 9-10, A-K comparative examples).

| | C | Mn | Al | Si | P | Ti | V | Mo* | S* | B* | N* | Sn | Cr | Si + Al | $P_c$ | Tnr | Ac1 | Ac3 | Bs | Ms | Ms |
|---|---|---|---|---|---|---|---|---|---|---|---|---|---|---|---|---|---|---|---|---|---|
| 1 | 0.183 | 2.46 | 0.008 | 1.00 | 0.012 | 0.019 | 0.13 | — | 2 | 23 | 32 | 0.055 | — | 1.00 | 0.354 | 648 | 710 | 852 | 546 | 380 | 385 |
| 2 | 0.187 | 2.469 | 0.404 | 0.615 | 0.013 | — | 0.118 | — | 9 | 21 | 30 | — | — | 1.02 | 0.344 | 908 | 717 | 866 | 553 | 392 | 393 |
| 3 | 0.189 | 2.459 | 0.027 | 1.004 | 0.014 | 0.019 | — | — | 3 | 19 | 14 | — | — | 1.02 | 0.347 | 633 | 706 | 835 | 543 | 378 | 365 |
| 4 | 0.192 | 2.449 | 0.025 | 1.003 | 0.013 | 0.019 | 0.122 | — | 15 | 21 | 21 | — | — | 1.02 | 0.362 | 653 | 711 | 850 | 543 | 377 | 380 |
| 5 | 0.185 | 2.479 | 0.641 | 0.418 | 0.013 | — | — | — | 2 | 22 | 30 | — | — | 1.02 | 0.325 | 1049 | 717 | 863 | 555 | 401 | 384 |
| 6 | 0.203 | 2.506 | 0.643 | 0.416 | 0.012 | — | — | — | 8 | 23 | 31 | — | — | 1.00 | 0.344 | 1059 | 717 | 859 | 548 | 393 | 375 |
| 7 | 0.205 | 2.460 | 0.019 | 0.995 | 0.013 | 0.020 | — | — | 6 | 21 | 17 | — | — | 1.00 | 0.363 | 641 | 706 | 831 | 539 | 371 | 358 |
| 8 | 0.161 | 3.460 | 0.641 | 0.420 | 0.013 | — | — | 60 | 4 | 22 | 4 | — | — | 1.00 | 0.350 | 1035 | 703 | 858 | 475 | 382 | 359 |
| 9 | 0.187 | 1.971 | 0.107 | 0.593 | 0.009 | — | — | — | — | 9 | 30 | — | — | 0.700 | 0.307 | 801 | 714 | 837 | 596 | 399 | 388 |
| 10 | 0.188 | 1.958 | 0.105 | 0.594 | 0.009 | — | — | — | — | 17 | 26 | — | — | 0.699 | 0.307 | 800 | 714 | 836 | 597 | 399 | 388 |
| 11 | 0.188 | 2.481 | 0.104 | 0.610 | 0.013 | — | — | — | — | 8 | 18 | — | — | 0.714 | 0.334 | 794 | 707 | 829 | 552 | 383 | 370 |
| 12 | 0.188 | 2.482 | 0.104 | 0.615 | 0.013 | — | — | — | — | 17 | 22 | — | — | 0.719 | 0.334 | 792 | 706 | 829 | 552 | 383 | 370 |
| A | 0.25 | 2.4 | — | 0.2 | — | — | — | — | — | — | — | — | — | 0.20 | 0.379 | 921 | 706 | 796 | 552 | 359 | 349 |
| B | 0.25 | 2.4 | — | 0.2 | — | — | — | — | — | — | — | — | — | 0.20 | 0.379 | 921 | 706 | 796 | 552 | 359 | 349 |
| C | 0.31 | 2.5 | — | 1.6 | — | — | — | — | — | — | — | — | — | 1.60 | 0.490 | 449 | 704 | 818 | 496 | 320 | 306 |
| D | 0.30 | 2.0 | — | 1.6 | — | — | — | — | — | — | — | — | 0.52 | 1.60 | 0.481 | 445 | 726 | 825 | 507 | 339 | 321 |
| E | 0.20 | 2.3 | — | 1.6 | — | — | — | — | — | — | — | — | — | 1.60 | 0.370 | 398 | 712 | 841 | 541 | 372 | 359 |
| F | 0.20 | 2.3 | — | 1.6 | — | — | — | — | — | — | — | — | — | 1.60 | 0.370 | 398 | 712 | 841 | 541 | 372 | 359 |
| G | 0.20 | 2.3 | — | 1.6 | — | — | — | — | — | 19 | — | — | — | 1.60 | 0.370 | 415 | 712 | 844 | 541 | 372 | 359 |
| H | 0.25 | 1.78 | — | 1.48 | — | — | — | — | — | 19 | — | — | — | 1.48 | 0.390 | 481 | 725 | 840 | 576 | 368 | 358 |
| I | 0.25 | 1.78 | — | 1.48 | — | — | — | — | — | — | — | — | — | 1.48 | 0.390 | 464 | 725 | 836 | 576 | 368 | 358 |
| J | 0.25 | 2.4 | — | 0.21 | — | — | — | — | — | — | — | — | — | 0.21 | 0.379 | 918 | 706 | 796 | 551 | 359 | 349 |
| K | 0.25 | 2.4 | — | 0.21 | — | — | — | — | — | — | — | — | — | 0.21 | 0.379 | 918 | 706 | 796 | 551 | 359 | 349 |

—: residual element. Not added deliberately.

TABLE 2

Process conditions of cold rolled and annealed strip and results (without temper rolling).

| | FT | CT | t (HR) mm | t (CR) mm | T anneal* | $OA^x$ | E | Rp | Rm | Rp/Rm | Ag | JIS5 | Tnr | Ac1 | Ac3 | Bs | Bs-hybr | Ms | Ms |
|---|---|---|---|---|---|---|---|---|---|---|---|---|---|---|---|---|---|---|---|
| 1 | austen- | 550 | 4 | 1.03 | 800 | 400 | 187 | 692 | 1328 | 0.52 | 8.3 | 11.5 | 648 | 710 | 852 | 546 | 526 | 380 | 385 |
| 1 | itic | 550 | | 1.04 | 800 | 400 | 185 | 714 | 1371 | 0.52 | 8.2 | 12.6 | | | | | | | |

TABLE 2-continued

Process conditions of cold rolled and annealed strip and results (without temper rolling).

| FT | CT | t (HR) mm | t (CR) mm | T anneal* | OA[x] | E | Rp | Rm | Rp/Rm | Ag | JIS5 | Tnr | Ac1 | Ac3 | Bs | Bs-hybr | Ms | Ms |
|---|---|---|---|---|---|---|---|---|---|---|---|---|---|---|---|---|---|---|
| 1 | 550 | | 1.04 | 800 | 400 | 185 | 695 | 1352 | 0.51 | 8.8 | 11.6 | | | | | | | |
| 1 | 550 | | 1.01 | 840 | 450 | 214 | 900 | 1418 | 0.63 | 6.3 | 9.3 | | | | | | | |
| 1 | 550 | | 1.02 | 840 | 450 | 209 | 906 | 1431 | 0.63 | 6 | 9.4 | | | | | | | |
| 1 | 550 | | 1.02 | 840 | 450 | 210 | 864 | 1396 | 0.62 | 5.6 | 7.8 | | | | | | | |
| 2 | 535 | | 1.03 | 800 | 400 | 189 | 783 | 1316 | 0.59 | 6.8 | 10.2 | 908 | 717 | 866 | 553 | 534 | 392 | 393 |
| 2 | 535 | | 1.03 | 800 | 400 | 194 | 777 | 1322 | 0.59 | 7 | 10.2 | | | | | | | |
| 2 | 535 | | 1.01 | 800 | 400 | 202 | 733 | 1266 | 0.58 | 7.5 | 10 | | | | | | | |
| 2 | 535 | | 1.01 | 840 | 450 | 196 | 789 | 1308 | 0.60 | 6.5 | 9.7 | | | | | | | |
| 2 | 535 | | 1.01 | 840 | 450 | 216 | 770 | 1318 | 0.58 | 6.5 | 9 | | | | | | | |
| 3 | 590 | | 0.99 | 840 | 400 | 192 | 827 | 1341 | 0.62 | 7.4 | 10.9 | 633 | 706 | 835 | 543 | 542 | 378 | 365 |
| 3 | 590 | | 1.01 | 840 | 400 | 190 | 786 | 1231 | 0.64 | 8.7 | 11.9 | | | | | | | |
| 3 | 590 | | 1.06 | 840 | 380 | 188 | 878 | 1360 | 0.65 | 6.2 | 8.9 | | | | | | | |
| 3 | 590 | | 1.05 | 840 | 380 | 189 | 883 | 1361 | 0.65 | 7.2 | 10.7 | | | | | | | |
| 4 | 590 | | 1.06 | 840 | 400 | 178 | 870 | 1396 | 0.62 | 6.5 | 10.1 | 653 | 711 | 850 | 543 | 523 | 377 | 380 |
| 4 | 590 | | 1.05 | 840 | 400 | 183 | 884 | 1401 | 0.63 | 6.1 | 8.6 | | | | | | | |
| 4 | 590 | | 1.02 | 840 | 380 | 193 | 962 | 1453 | 0.66 | 5 | 6.9 | | | | | | | |
| 4 | 590 | | 1.03 | 840 | 380 | 194 | 958 | 1466 | 0.65 | 6.1 | 8.6 | | | | | | | |
| 5 | 590 | | 0.99 | 840 | 400 | 190 | 593 | 1069 | 0.55 | 10.5 | 15 | 1049 | 717 | 863 | 555 | 555 | 401 | 384 |
| 5 | 590 | | 0.99 | 840 | 400 | 193 | 589 | 1070 | 0.55 | 9.8 | 13.1 | | | | | | | |
| 5 | 590 | | 1.02 | 840 | 380 | 188 | 684 | 1072 | 0.64 | 9 | 12.9 | | | | | | | |
| 5 | 590 | | 1.02 | 840 | 380 | 181 | 640 | 1079 | 0.59 | 9.8 | 13.7 | | | | | | | |
| 6 | 590 | | 1.03 | 840 | 400 | 190 | 659 | 1123 | 0.59 | 10.4 | 14.9 | 1059 | 717 | 859 | 548 | 547 | 393 | 375 |
| 6 | 590 | | 1.04 | 840 | 400 | 198 | 628 | 1109 | 0.57 | 10.4 | 14.1 | | | | | | | |
| 6 | 590 | | 1.038 | 840 | 380 | 185 | 646 | 1083 | 0.60 | 10 | 14.4 | | | | | | | |
| 6 | 590 | | 1.029 | 840 | 380 | 173 | 640 | 1099 | 0.58 | 10.4 | 14.8 | | | | | | | |
| 7 | 590 | | 1.031 | 840 | 400 | 185 | 1016 | 1490 | 0.68 | 5.3 | 7.7 | 641 | 706 | 831 | 539 | 538 | 371 | 358 |
| 7 | 590 | | 1.03 | 840 | 400 | 187 | 1044 | 1529 | 0.68 | 5.7 | 8.3 | | | | | | | |
| 7 | 590 | | 0.994 | 840 | 380 | 191 | 944 | 1462 | 0.65 | 6.5 | 9.4 | | | | | | | |
| 7 | 590 | | 0.999 | 840 | 380 | 189 | 925 | 1427 | 0.65 | 6.6 | 9.7 | | | | | | | |
| 8 | 590 | | 1.082 | 840 | 400 | 183 | 931 | 1399 | 0.67 | 4.4 | 6.8 | 1035 | 706 | 858 | 475 | 475 | 382 | 359 |
| 8 | 590 | | 1.09 | 840 | 400 | 173 | 893 | 1360 | 0.66 | 5.5 | 8.6 | | | | | | | |
| 8 | 590 | | 1.07 | 840 | 380 | 180 | 913 | 1403 | 0.65 | 5.9 | 9.7 | | | | | | | |
| 8 | 590 | | 1.07 | 840 | 380 | 189 | 919 | 1408 | 0.65 | 5.5 | 8.4 | | | | | | | |
| 9 inter- | 600 | | 1.00 | 835 | Q400 | 202 | 840 | 1021 | 0.82 | 6.6 | 9.9 | 801 | 714 | 837 | 596 | 596 | 399 | 388 |
| 9 critical | 600 | | 1.00 | 835 | Q400 | 200 | 858 | 1004 | 0.85 | 3.8 | 6.6 | | | | | | | |
| 9 | 600 | | 1.01 | 835 | 400 | 200 | 830 | 1002 | 0.83 | 4.8 | 7.5 | | | | | | | |
| 10 | 600 | | 0.99 | 835 | Q400 | 203 | 851 | 1006 | 0.85 | 4.6 | 7.1 | 800 | 714 | 836 | 597 | 597 | 399 | 388 |
| 10 | 600 | | 0.99 | 835 | Q400 | 204 | 843 | 1010 | 0.83 | 6.3 | 8.7 | | | | | | | |
| 10 | 600 | | 0.99 | 835 | 400 | 198 | 798 | 1001 | 0.80 | 6.3 | 9.2 | | | | | | | |
| 10 | 600 | | 1.00 | 835 | 400 | 204 | 780 | 1001 | 0.79 | 5.2 | 7.6 | | | | | | | |
| 11 inter- | 600 | | 1.00 | 800 | — | 194 | 642 | 1226 | 0.52 | 8.8 | 12.4 | 794 | 707 | 829 | 552 | 552 | 383 | 370 |
| 11 critical | 600 | | 1.00 | 800 | — | 191 | 641 | 1220 | 0.53 | 8.7 | 11.8 | | | | | | | |
| 11 | 600 | | 0.98 | 835 | Q400 | 195 | 776 | 1201 | 0.65 | 6.9 | 8.9 | | | | | | | |
| 11 | 600 | | 1.00 | 835 | 400 | 201 | 770 | 1164 | 0.66 | 7.3 | 11 | | | | | | | |
| 11 | 600 | | 1.00 | 835 | 400 | 197 | 781 | 1169 | 0.67 | 6.7 | 8.5 | | | | | | | |
| 12 inter- | 600 | | 0.99 | 800 | — | 194 | 695 | 1260 | 0.55 | 8.2 | 11.6 | 792 | 706 | 829 | 552 | 552 | 383 | 370 |
| 12 critical | 600 | | 1.00 | 800 | — | 191 | 720 | 1272 | 0.57 | 8.5 | 12.3 | | | | | | | |
| 12 austen- | 600 | | 1.00 | 835 | Q400 | 198 | 809 | 1167 | 0.69 | 4.8 | 6.3 | | | | | | | |
| 12 itic | 600 | | 1.00 | 835 | Q400 | 199 | 797 | 1160 | 0.69 | 4.6 | 6 | | | | | | | |
| 12 | 600 | | 1.00 | 835 | 400 | 195 | 802 | 1236 | 0.65 | 6.5 | 9.3 | | | | | | | |
| 12 | 600 | | 1.00 | 835 | 400 | 193 | 797 | 1221 | 0.65 | 6 | 9.1 | | | | | | | |

*Continuous annealing top temperature

[x]Q: quench to 350° C. followed by overage at 400° C.

Tnr: $T_{nr}$ = 887 + 464 C + (6445 Nb − 644 $\sqrt{Nb}$) + (732 V − 230 $\sqrt{V}$) + 890 Ti + 363 Al − 357 Si Ac1 $Ac_1$ = 723 − 7.08 Mn + 37.7 Si + 18.1 Cr + 44.2 Mo + 8.95 Ni + 50.1 V + 21.7 Al + 3.18 W + 297 S − 830 N − 11.5 C Si − 14.0 Mn Si − 3.10 Si Cr − 57.9 C Mo − 15.5 Mn Mo − 5.28 C Ni − 6.0 Mn Ni + 6.77 Si Ni − 0.80 Cr Ni − 27.4 C V + 30.8 Mo V − 0.84 $Cr^2$ − 3.46 $Mo^2$ − 0.46 $Ni^2$ − 28 $V^2$ Ac3 $Ac_3$ = 912 − 370 C − 27.4 Mn + 27.3 Si − 6.35 Cr − 32.7 Ni + 95.2 V + 190 Ti + 72.0 Al + 64.5 Nb + 5.57 W + 332 S + 276 P + 485 N − 900 B + 16.2 C Mn + 32.3 C Si + 15.4 C Cr + 48.0 C Ni + 4.32 Si Cr − 17.3 Si Mo − 18.6 Si Ni + 4.80 Mn Ni + 40.5 Mo V + 174 $C^2$ + 2.46 $Mn^2$ − 6.86 $Si^2$ + 0.322 $Cr^2$ + 9.90 $Mo^2$ + 1.24 $Ni^2$ − 60.2 $V^2$ Bs $B_s$ = 839 − 86 Mn − 23 Si − 67 Cr − 33 Ni − 75 Mo − 270 [1 − exp(−1.33 C)]

Ms $M_s$ = 540 − 420 C − 35 Mn − 12 Cr − 20 Ni − 21 Mo − 10.5 Si − 10.5 W + 20 Al + 140 V

TABLE 3

Process conditions of hot rolled strip and results

| Cast | FT_in | CT | t (HR) mm | E | Rp | Rm | Rp/Rm | Ag | A50 | Hole expansion |
|---|---|---|---|---|---|---|---|---|---|---|
| 2 | 900 | 500 | 4.2 | 200 | 574 | 874 | 0.52 | 7.8 | 12.6 | 27 |
| 2 | 900 | 500 | 4.2 | 202 | 573 | 884 | 0.52 | 8.1 | 12.8 | 43 |
| 2 | 900 | 500 | 4.3 | 195 | 596 | 888 | 0.51 | 8.6 | 13.5 | 51 |
| 2 | 900 | 500 | 4.2 | 193 | 585 | 879 | 0.63 | 9.2 | 14.5 | 56 |
| 2 | 900 | 500 | 4.2 | 191 | 589 | 882 | 0.63 | 8.6 | 14.5 | n.d. |
| 2 | 900 | 500 | 4.2 | 194 | 602 | 867 | 0.62 | 8.3 | 13.7 | n.d. |
| 2 | 900 | 400 | 4.2 | 188 | 976 | 1176 | 0.59 | 5.7 | 11.4 | 83 |
| 2 | 900 | 400 | 4.2 | 171 | 607 | 1098 | 0.59 | 6.3 | 10.1 | 43 |
| 2 | 900 | 400 | 4.2 | 198 | 871 | 1152 | 0.58 | 6.4 | 11 | n.d. |
| 2 | 900 | 400 | 4.1 | 190 | 746 | 1127 | 0.60 | 6.6 | 10.8 | n.d. |
| 2 | 900 | 400 | 4.2 | 187 | 703 | 1106 | 0.58 | 6.6 | 11.2 | n.d. |

The invention claimed is:

1. A hot-rolled, cold-rolled and annealed, or cold-rolled, annealed and temper rolled steel strip or sheet having a complex phase steel microstructure comprising:

0.16-0.21 wt. % C;
2.3-4.00 wt. % Mn;
5-50 ppm B;
5-100 ppm N;
0.019-1.10 wt. % Al tot which is the sum of aluminum present as alumina and any other aluminum;
0.05-1.10 wt. % Si;
0-0.04 wt. % Ti, wherein if Al is below 0.030 wt. % Ti is 0.010-0.04 wt. %;
0-0.10 wt. % Cu;
0-0.10 wt. % Mo;
0-0.10 wt. % Ni;
0-0.20 wt. % V;
0-0.05 wt. % P;
0-0.05 wt. % S;
0-0.10 wt. % Sn;
0-0.025 wt. % Nb
0-0.025 wt. % Ca;
remainder iron and inevitable impurities,
wherein the steel has a cracking parameter value, Pc, of at most 0.365, wherein $$P_c = C + \frac{Si}{30} + \frac{Mn + Cu + Cr}{20} + \frac{Mo}{15} + \frac{V}{10} + \frac{d}{600}$$

and wherein the alloying contents are given in wt. % and the plate thickness d, is given in mm, wherein the steel strip or sheet after hot-rolling has a yield strength of at least 500 MPa and a tensile strength of at least 850 MPa, or
wherein the steel strip or sheet after cold-rolling and annealing has a yield strength of at least 550 MPa and a tensile strength of at least 1000 MPa, or
wherein the steel strip or sheet after cold-rolling and annealing and temper rolling has a yield strength of at least 600 MPa and a tensile strength of at least 1200 MPa,
wherein the steel microstructure consists of a mixture of martensite with retained austenite, and a remainder being carbide free bainite consisting of bainite with retained austenite without the presence of cementite,
wherein the martensite is at least one member selected from the group consisting of tempered martensite and untempered martensite,
wherein the steel microstructure is between 0 and 50 vol. % tempered martensite, and
wherein the steel microstructure is free from ferrite and free from pearlite.

2. The steel according to claim 1, wherein the boron content is 10-50 ppm.

3. The steel according to claim 1, wherein Ca is between 5 and 100 ppm.

4. The steel according to claim 1, wherein $\Sigma(Al+Si) \leq 1.25$.

5. The steel according to claim 1, wherein $\Sigma(Al+Si) \geq 0.60$.

6. The steel according to claim 1, wherein the vanadium content is between 0.118 and 0.20 wt. %.

7. The steel according to claim 1, wherein the manganese content is 2.3-3.6 wt. %.

8. The steel according to claim 1, wherein the silicon content is 0.30-1.10 wt. %.

9. The steel according to claim 1, wherein the cold-rolled and annealed strip has a yield strength of at least 600 MPa and a tensile strength of at least 1200 MPa.

10. The steel according to claim 1, wherein the silicon content is 0.05-1.05 wt. %.

11. The steel according to claim 1, wherein the boron content is 5-40 ppm.

12. The steel according to claim 1, wherein the Al tot content is 0.030-1.10 wt. %.

13. The steel according to claim 1, wherein the steel microstructure consists of tempered martensite, carbide free bainite and retained austenite.

14. The steel according to claim 1, wherein the steel has an absence of Cr.

15. A method of manufacturing a hot-rolled or cold-rolled and annealed steel strip or sheet of claim 1 having a complex phase steel microstructure, the method comprising the step of casting a slab, comprising:

0.16-0.21 wt. % C;
2.3-4.00 wt. % Mn;
5-50 ppm B;
5-100 ppm N;
0.019-1.10 wt. % Al tot;
0.05-1.10 wt. % Si;
0-0.04 wt % Ti, wherein if Al is below 0.030 wt. % Ti is 0.010-0.04 wt. %;
0-0.10 wt. % Cu;
0-0.10 wt. % Mo;
0-0.10 wt. % Ni;
0-0.20 wt. % V;
0-0.05 wt. % P;
0-0.05 wt. % S;
0-0.10 wt. % Sn;
0-0.025 wt. % Nb;
0-0.025 wt. % Ca;

remainder iron and inevitable impurities;

followed by the step of reheating the solidified slab to a temperature of between 1100 and 1300° C., hot rolling the steel slab and finishing said hot rolling at a finish hot rolling temperature at the Ar3-temperature or higher, wherein Ar3-temperature is a temperature at which austenite begins to transform to ferrite during cooling, cooling the hot-rolled strip at a cooling rate of between 5 and 220° C/s and coiling the hot rolled steel strip or sheet in the temperature range between 200 and 625° C., optionally followed by cold-rolling and annealing, wherein the steel has a cracking parameter value, Pc, of at most 0.365, wherein $$P_c = C + \frac{Si}{30} + \frac{Mn + Cu + Cr}{20} + \frac{Mo}{15} + \frac{V}{10} + \frac{d}{600}$$

and wherein the alloying contents are given in wt. % and the plate thickness d, is given in mm, wherein the finished steel strip or sheet after hot-rolling has a yield strength of at least 500 MPa and a tensile strength of at least 850 MPa, or wherein the finished steel strip or sheet after cold-rolling and annealing has a yield strength of at least 550 MPa and a tensile strength of at least 1000 MPa, or wherein the finished steel strip or sheet after cold-rolling and annealing and temper-rolling has a yield strength of at least 600 MPa and a tensile strength of at least 1200 MPa, wherein the steel microstructure consists of a mixture of martensite with retained austenite, and a remainder being carbide free bainite consisting of bainite with retained austenite without the presence of cementite, wherein the martensite is at least one member selected from the group consisting of tempered martensite and untempered martensite, wherein the steel microstructure is between 0 and 50 vol. % tempered martensite, and wherein the steel microstructure is free from ferrite and free from pearlite.

16. The method according to claim 15, wherein the coiling temperature is between 350 and 550° C.

17. The method according to claim 16, wherein the steel strip or sheet is provided with a zinc or zinc alloy coating, or an aluminium-silicon alloy coating, and optionally galvannealed after coating.

18. The method according to claim 15, wherein the hot-rolled steel strip is pickled, cold-rolled, annealed at an annealing temperature of between Ac1-temperature and Ac3-temperature, or above Ac3-temperature, cooled and optionally temper rolled, and wherein the yield strength of the rolled strip or the temper rolled strip is at least 600 MPa and the tensile strength is at least 1000 MPa, wherein Ac1-temperature is a temperature at which austenite begins to form during heating, and wherein Ac3-temperature is a temperature at which transformation of ferrite to austenite is completed during heating.

19. The method according to claim 18, wherein the tensile strength is at least 1200 MPa.

20. The method according to claim 15, wherein the hot-rolled steel is pickled, cold-rolled, annealed at an annealing temperature of between Ac1-temperature and Ac3-temperature, or above Ac3-temperature, cooled followed by a low temperature annealing, at an annealing temperature of between 170 to 350° C. during 12 to 250 hours, and optionally temper rolled, wherein Ac3-temperature is a temperature at which austenite begins to form during heating, and wherein Ac3-temperature is a temperature at which transformation of ferrite to austenite is completed during heating.

* * * * *